US005833382A

United States Patent [19]

Jenks et al.

[11] Patent Number: 5,833,382

[45] Date of Patent: Nov. 10, 1998

[54] PUSH-UP DISPENSER SUITABLE FOR DILATANT MATERIALS

[75] Inventors: Rebecca Sue Moen Jenks, Cary, Ill.; Kurt Gerard Baumann, Kenosha, Wis.

[73] Assignee: Helene Curtis, Inc., Chicago, Ill.

[21] Appl. No.: 699,478

[22] Filed: Aug. 19, 1996

[51] Int. Cl.[6] ..... A45D 40/02

[52] U.S. Cl. ..... 401/82; 401/176; 401/188 R; 401/262; 401/266

[58] Field of Search ..... 401/82, 188 A, 401/188 R, 176, 262, 266

[56] References Cited

U.S. PATENT DOCUMENTS

| | | | |
|---|---|---|---|
| Re. 34,751 | 10/1994 | Thompson . | |
| 718,969 | 1/1903 | Altshul . | |
| 767,469 | 8/1904 | Ziegler et al. | 401/176 |
| 850,357 | 4/1907 | Doyle . | |
| 1,848,358 | 3/1932 | Kratz | 401/187 |
| 1,988,088 | 1/1935 | Philippe . | |
| 2,085,446 | 6/1937 | Philippe . | |
| 2,458,120 | 1/1949 | Volpini . | |
| 2,917,765 | 12/1959 | Jakubowski . | |
| 3,010,138 | 11/1961 | Nadai . | |
| 3,203,024 | 8/1965 | Hawkins et al. . | |
| 3,493,147 | 2/1970 | Ballin . | |
| 4,139,127 | 2/1979 | Gentile . | |
| 4,169,547 | 10/1979 | Newell | 401/176 X |
| 4,595,124 | 6/1986 | Duval et al. . | |
| 4,708,267 | 11/1987 | Sieverding et al. . | |
| 4,708,507 | 11/1987 | von Schuckmann . | |
| 4,726,700 | 2/1988 | Gray . | |
| 4,782,983 | 11/1988 | Cook . | |
| 4,801,052 | 1/1989 | Citterio . | |
| 4,819,836 | 4/1989 | Meckenstock . | |
| 4,865,231 | 9/1989 | Wiercinski . | |
| 5,000,356 | 3/1991 | Johnson et al. . | |
| 5,073,057 | 12/1991 | Lathrop et al. . | |
| 5,092,496 | 3/1992 | Gayle et al. . | |
| 5,120,148 | 6/1992 | Waters et al. . | |
| 5,275,496 | 1/1994 | Fattori et al. . | |

FOREIGN PATENT DOCUMENTS

| | | | |
|---|---|---|---|
| 0100204 | 2/1984 | European Pat. Off. . | |
| 256923 | 2/1988 | European Pat. Off. | 401/176 |
| 0312165 | 4/1989 | European Pat. Off. . | |
| 493658 | 5/1954 | Italy | 401/176 |
| 281384 | 6/1952 | Switzerland . | |
| WO96/03899A1 | 2/1996 | WIPO . | |

*Primary Examiner*—Steven A. Bratlie
*Attorney, Agent, or Firm*—Matthew Boxer

[57] ABSTRACT

A dispensing container for dispensing a desired quantity of a highly viscous material. The dispenser includes a generally tubular housing having an upper edge, an inner surface, a top secured to the upper end of the housing with at least one restricted dispensing opening, and a platform with a peripheral edge mounted for reciprocal axial movement within the housing. The peripheral edge of the platform is slidingly guided by the inner surface of the housing and supports the platform at a desired position within the housing. Further, the platform is slidably advanced towards the dispensing opening in the top by exertion of force by a user, where the force compresses the material against the top. Upon release of the force, the platform slidably moves in a reverse direction to relieve the stress in the material.

7 Claims, 2 Drawing Sheets

PUSH-UP DISPENSER SUITABLE FOR DILATANT MATERIALS

BACKGROUND OF THE INVENTION

The present invention relates generally to a dispensing container and, more particularly, to a dispensing container suitable for dispensing dilatant materials.

Platform type dispensers are well known for dispensing personal care products such as antiperspirants. One such product is an antiperspirant stick, which is moved to the upper or dispensing end of the container by the user pushing upward on a platform until the material protrudes past the dispenser a sufficient distance for application. After use, if desired, the material can be pushed back into the container by the user. While such antiperspirant sticks are popular, other types of antiperspirant materials have been developed which require alternative dispensing devices. Clear antiperspirant gels and opaque creams have recently been developed which are packaged in platform containers advanced by turning a knob at the lower end of the container to rotate a screw to raise the platform a measured amount. One such dispenser is disclosed in U.S. Pat. No. Re. 34,751. Such containers are equipped with an apertured grille across an open upper end. The antiperspirant is forced through the openings or apertures upon elevation of the platform. A common problem of such dispensers is that after application of the product, residual stress from the initial force exerted upon the material causes "weeping", which is unwanted extrusion through the dispensing apertures as well as "creeping" which is extrusion of the liquid component. This results in waste of product and mess for the user.

A soft-solid material has been recently developed that is a more effective antiperspirant than conventional antiperspirant sticks, roll-ons or gels and does not whiten and leave a residue upon the user's skin or clothing. The soft-solid material is a complex fluid with a high number of solids dispersed in a silicone medium, and has the consistency of a thick cream. While this material has been found to be more effective as an antiperspirant, the material creates several challenges in designing a suitable dispenser.

One performance factor associated with the soft-solid material is that it is dilatant. Normal fluids are considered isotropic, that is, pressure applied to a liquid is transmitted equally in all directions throughout the liquid. However, soft-solid materials can be anisotropic, in that the stress applied to the material by the platform is transmitted, at least in part, through the solid particles, and not the liquid, and further is not transmitted equally in all directions. This is due to the particles pushing against one another as they try to move in a high particulate volume fraction system. Such behavior is typical of dilatant materials, and results in an increase in viscosity with increasing shear and also results in the tendency for the material to increase in volume when stress is applied. This is particularly troublesome when the soft-solid material is subject to a sudden constriction, such as caused by the openings in the dispensing end of a conventional platform screw-advanced container. In fact, it has been suggested that some of the stress applied to the present soft-solid material by the platform is transmitted to the walls of the container, reducing the driving force required to move the material through the package openings. This reduced stress through the openings may not be sufficient to induce flow of the material, and requires that the user generate a greater force to dispense the material than would normally be expected.

Another characteristic of the present soft-solid material is its behavior under stress as a function of time. If dispensed continuously, the material can be extruded without incurring any problems. However, when the material is dispensed in steps, such as the daily application of an antiperspirant where the platform is held in a fixed position after each application, the soft-solid material has a tendency to seize. This suggests that the soft-solid material remains under stress, even though the flow through the dispensing end has ceased.

Further, it is believed that the residual stress between the solid particles causes them to bond, eventually causing the material to seize inside the container. In addition, this stress increases the tendency for the liquid component of the material to continue to flow, leaving the bonded solids behind, that process being referred to herein as "creeping."

Attempts to address these performance factors have concentrated on releasing the residual stress. One approach is to use a spring, similar to that used in caulking guns, where the spring pushes the platform away from the material being dispensed. A variation of this approach is to use a feed screw and a spring in conjunction with the platform, where the spring reverses the rotation of the feed screw, retracting the platform. One problem inherent with this latter approach is the unpredictability of the amount of retraction that will occur. The amount of retraction, and thus the amount of residual stress remaining in the material, will depend on the material dispensed, age of the material and the container, type of spring, friction, etc. There is no assurance that the amount of retraction will be sufficient to prevent weeping, and there is no assurance that this type of container will retract the platform sufficiently to remove all residual stress in the material.

Yet another approach is to use a feed screw in conjunction with internal cams. The feed screw advances the platform a set distance upward, after which the internal cams retract the platform a lesser distance to relieve pressure on the material. While this approach allows the amount of retraction to be predicted, the distance of retraction of the platform is not determined by the residual stress, but by the configuration of the internal cams. Since the internal cams only allow the platform to retract a set distance, it is conceivable that not all the residual stress in the material is relieved, resulting in the weeping problem discussed above.

Moreover, the approaches set forth above are relatively expensive, and require the manufacture and assembly of springs, feed screws and/or the internal cams, in addition to producing the containers and materials.

Accordingly, a first object of the present invention is to provide an improved dispensing container that relieves substantially all the stress in the material and prevents weeping.

A second object of the present invention is to provide an improved dispensing container that facilitates the dispensing of cream products without undermining the physical properties of the material.

Another object is to provide an improved dispensing container that is both cheaper to manufacture and easier to assemble than conventional containers.

A further object of the present invention is to provide an improved dispensing container that relieves substantially all the stress in a dilatant soft-solid cream material, allowing the material to maintain its physical structure throughout its useful life.

Other objects and advantages of the invention will become apparent from the following description and accompanying drawings.

SUMMARY OF THE INVENTION

The above identified objectives are met or exceeded by the present dispensing container, which features the ability to dispense a desired quantity of a dilatant or soft-solid material. An important feature of the present invention is a free floating platform that falls back of its own weight away from the dispensing end. As a result, substantially all of the residual stress in the soft-solid material is relieved and weeping is prevented. Yet another important feature of the present invention is a replaceable cap defining an internal space for trapping a volume of air. This volume of air pushes against the soft-solid material at the dispensing end of the container, moving the material away from the dispensing end and into the inner chamber of the container. Weeping of the material is prevented, and the material's structure is maintained throughout its useful life.

More specifically, the present container for dispensing a desired quantity of a highly viscous material includes a generally tubular housing with an upper end, an inner surface and a top with at least one restricted dispensing opening, secured to the upper end of the housing. A platform is located in the housing for reciprocal axial movement, and a peripheral edge of the platform is slidingly guided by the inner surface of the housing and supports the platform at a desired position. The platform is configured for slidably advancing towards the dispensing opening by exertion of force by a user, where the force compresses the material against the top. Upon release of this force, the platform is configured to slidably move in a reverse direction to relieve residual stress in the material.

In another embodiment, the present invention includes the dispensing container for dispensing a material similar to that discussed above in combination with the material to be dispensed. A highly viscous dilatant or soft-solid material is contained in the housing upon the platform, where the material is composed of a composition that releasably adheres to the platform and the inner surface. This composition includes a particles constituent, a non-volatile emollient, a gelling agent and a particle thickener.

DETAILED DESCRIPTION OF THE INVENTION

Figure 2:
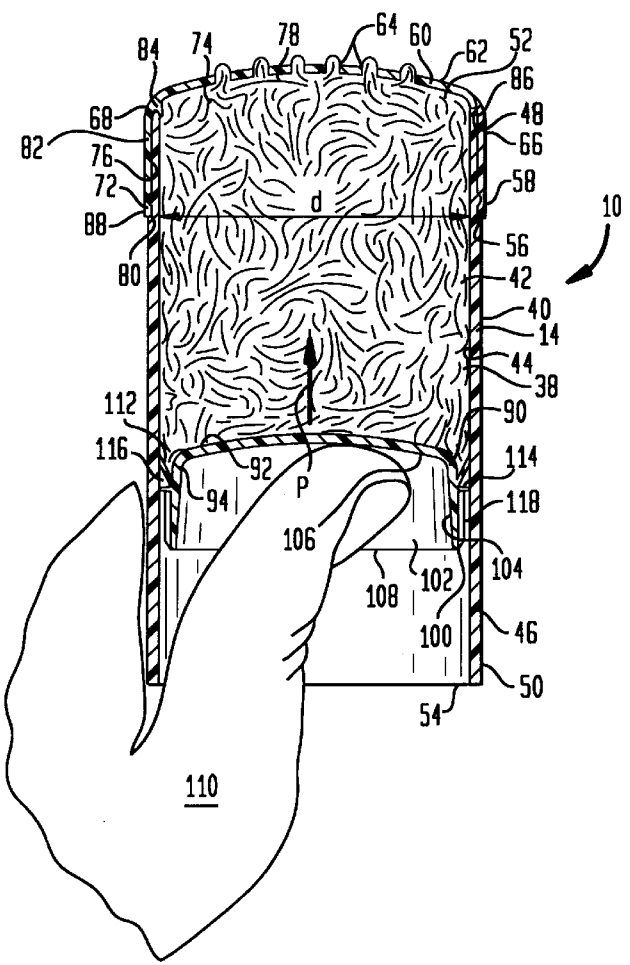
FIG. 2 is a sectional view taken along line 2—2 of FIG. 1 and in the direction indicated generally.
Figure 1:
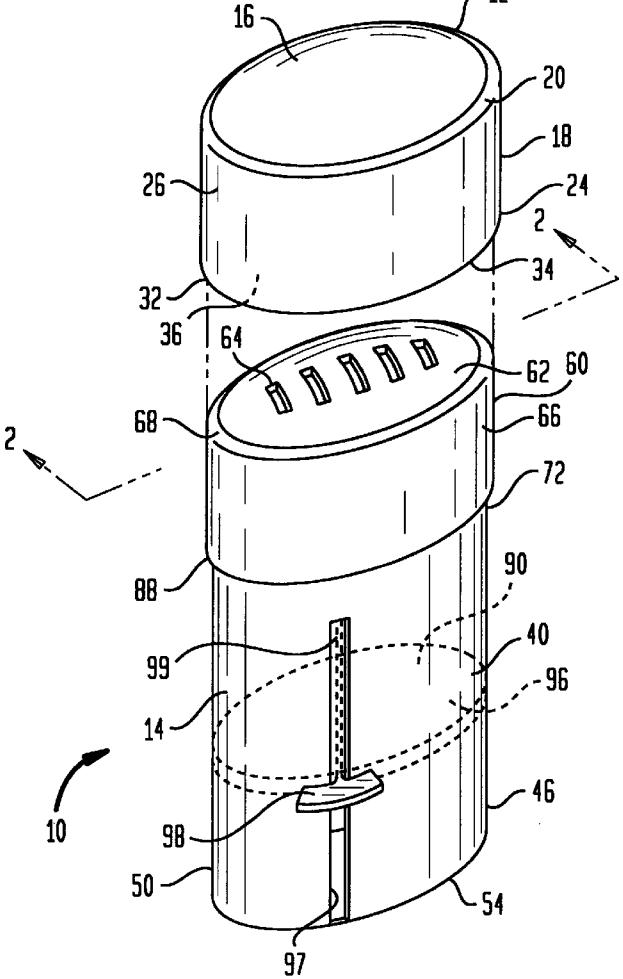
FIG. 1 is a top exploded perspective view of the present dispensing container.

Referring now to FIGS. 1 and 2, a dispensing container suitable for use with the present invention is generally designated 10 and has two components, a replaceable cap 12 and a housing 14. The replaceable cap 12, preferably made of rigid plastic suitable for injection molding, has an inverted cup-like shape. In the preferred embodiment, the replaceable cap 12 has an elliptical shape when viewed from above, however other configurations and materials are contemplated depending on the application. A generally domed lid 16 is included in the cap 12 with a skirt 18 depending from a peripheral edge 20 of the lid. The skirt 18 further has a lower cap edge 24.

Figure 4:
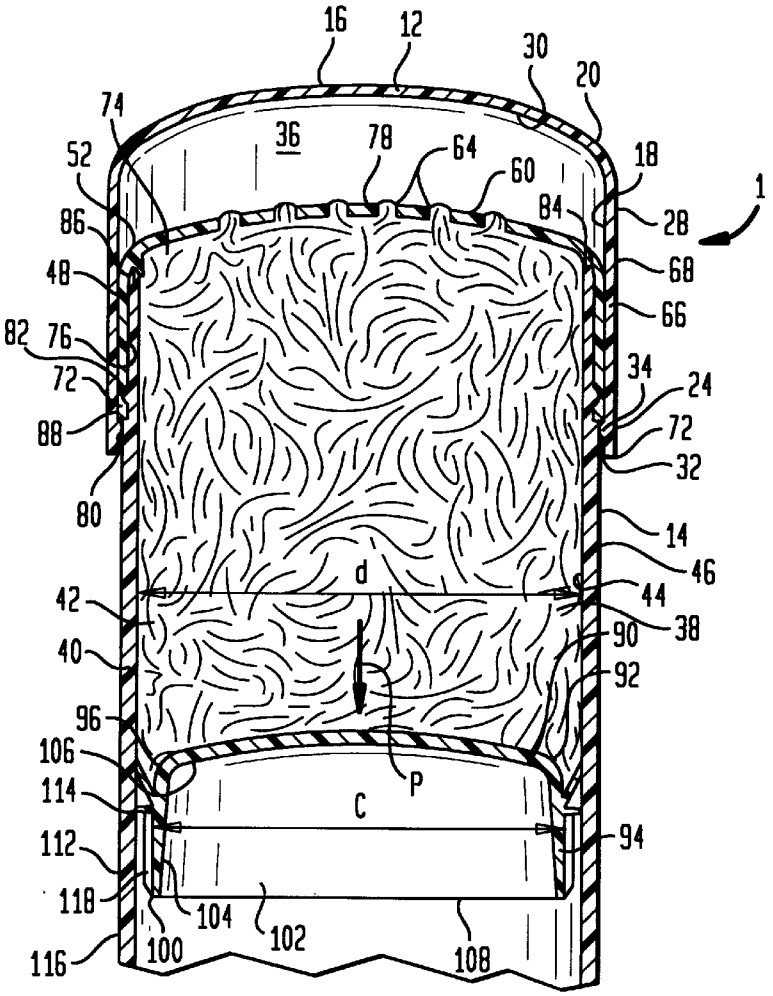
FIG. 4 is a vertical sectional view depicting the replaceable cap in a closed relationship upon the dispensing container of FIG. 3, depicting the platform axially receding in response to the replacement of the cap.

A chamber 26 is defined by an inner surface 28 (best seen in FIG. 4) of the skirt 18 and a generally domed inner surface 30 (also best seen in FIG. 4). Opposite the lid 16 is a lower opening 32. A first lip 34 (best seen in FIG. 4) projects generally radially inwardly from the inner surface 28, and extends around the inner circumference of the cap 12. In the preferred embodiment, the skirt 18 is configured to have a tight friction fit over the housing 14. Further, upon closing the dispensing container 10, the replaceable cap 12 engages an upper end of the housing 14 and traps a volume of air 36 therebetween to prevent weeping as will be discussed below.

Referring to FIG. 2, the housing 14, preferably made of rigid plastic suitable for injection molding, has a generally tubular, elliptical shape, and is configured for dispensing a desired quantity of a dilatant or soft-solid material 38. Although the generally tubular, elliptical shape and use of rigid plastic is preferred, other configurations and materials are contemplated, depending on the application. A generally tubular wall 40 in the housing 14 defines a housing chamber 42 via an inner surface 44. The housing 14 further includes an outer surface 46, an upper edge 48 adjacent the cap 12 and a lower edge 50 opposite the upper edge 48. The tubular wall 40 preferably has two openings, an upper opening 52 defined by the upper edge 48, and a lower opening 54 defined by the lower edge 50. In the preferred embodiment, the outer surface 46 of the housing 14 further has a seat 56 and a securing lip 58 that extends around the upper edge 48 for engaging and securing a top 60.

Figure 3:
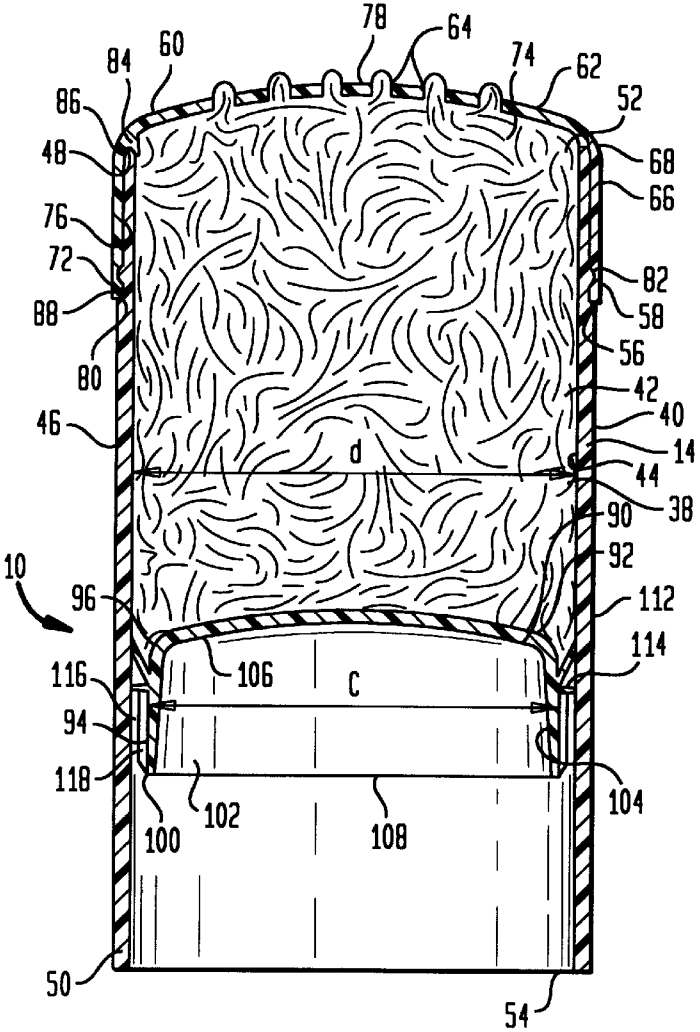
FIG. 3 is a vertical sectional view depicting the present dispensing container of FIG. 1 after dispensing material.

Referring now to FIGS. 2–4, the top 60 is secured to the housing 14 and is preferably made of rigid plastic suitable for injection molding into a generally inverted cup-like shape. As with the cap 12 and the housing 14 discussed above, in the preferred embodiment the top 60 has an elliptical shape when viewed from above. A generally domed lid 62 is included in the top 60, the lid 62 having at least one restricted dispensing opening 64 in fluid communication with the upper opening 52 for dispensing a desired quantity of the soft-solid material 38. For the purposes of the present container, the restricted opening means that at least 25% of restriction in a totally open upper opening 52. A top skirt 66 further depends from a top peripheral edge 68 of the lid and has a lower edge 72 that engages and rests in the seat 56 by virtue of a snap-type friction fit.

A top chamber 74 is defined by an inner surface 76 of the top skirt 66 and the domed top inner surface 78. A lower opening 80 is defined by the inner surface 76 opposite the lid 62. Preferably, the domed top 60 has an annular groove 82 inset in the inner surface 76 that extends around the inner circumference of the top 60 and frictionally accommodates the securing lip 58 of the housing 14, securing the top 60 to the housing. Additionally, the top 60 includes a second groove 84 defined by a tongue 86 that depends from an underside of the lid 62. The groove 84 is configured to receive the upper edge 48 of the housing 14, so that the groove 84 and the tongue 86 act in concert with the groove 82 and the securing lip 58 to secure the top 60 to the housing 14 in a snap-type friction fit. While this snap-type configuration of the grooves 82 and 84, the tongue 86 and the securing lip 58 is preferred, other securing methods are contemplated including ultrasonic welding, chemical adhesives, as well as producing the top 60 and the housing 14 as one piece.

In the illustrated embodiment, the top skirt 66 and the lower edge 72 are not flush with the outer surface 46 of the housing 14. Instead, the lower edge 72 extends radially out from the seat 56 of the housing 14 to form an annular protuberance 88 (best seen in FIG. 4). To releasably secure the replaceable cap 12 to the housing 14, the first lip 34 engages the protuberance 88. As described above, the cap 12 is dimensioned to have a tight sliding fit over the housing 14, and the protuberance 88, which also prevents the unwanted detachment of the cap from the housing. While this relationship is preferred, it is contemplated that the top skirt 66 could be generally flush with the outer surface 46 of the housing 14.

Another important feature of the present invention is a platform 90 mounted for reciprocal axial movement within the housing 14. Preferably made of molded plastic, the platform 90 has a generally inverted cup-like shape, and like the cap 12, the housing 14 and the top 60, has a generally elliptical shape when viewed from above. Other shapes of platform are contemplated depending on the shape of the housing. The platform 90 preferably includes a generally domed upper surface 92 that supports the material 38 within the housing 14, with a skirt 94 depending from a peripheral edge 96 of the upper surface 92. Included on the platform skirt 94 is a lower platform edge 100.

A platform chamber 102 is defined by an inner surface 104 of the platform skirt 94 and an underside 106 of the upper surface 92. Opposite the underside 106 is a lower opening 108. In the preferred embodiment, the peripheral edge 96 is slidingly guided by the inner surface 44 of the housing 14, with sufficient frictional engagement to support the platform 90 at a desired position within the housing. The platform 90 is further configured for slidably advancing towards the dispensing openings 64 in a direction indicated by the arrow P (best seen in FIG. 2) by exertion of force by a user 110. Preferably, the user's thumb presses against either the platform edge 100 or the underside 106. In this manner, the soft-solid material 38 is dispensed through the openings 64. Upon release of the force by the user, the platform 90 is configured to slidably move in a reverse axial direction shown by arrow P' (best seen in FIG. 4) to relieve residual stress stored in the material 38. The soft-solid material 38 continues to push the platform 90 away from the dispensing openings 64 until substantially all of the residual stress is released. This slidability of the platform 90 prevents the soft-solid material 38 from weeping or creeping out the dispensing openings 64 after use.

Referring now to FIG. 1, an alternate apparatus for advancing the platform 90 to dispense the material 38 is depicted. Instead of advancing the platform 90 by thumb pressure as shown in FIG. 2, the housing 14 may be provided with a vertical slot 97 extending from a point at or adjacent to the lower opening 54. A finger tab 98 is secured through the slot 97, to the peripheral edge 96 of the platform 90. To prevent leakage of the material 38 from the slot 97 above the platform 90, a retractable and/or collapsible barrier 99 is provided to the slot. The barrier 99 may be made of a foil-like material which is bonded or otherwise secured to the inner surface 28 of the housing so that the bond securing the barrier to the surface 28 is ruptured as the platform 90 is elevated. Other types of tabs for vertically advancing the platform 90 are contemplated here.

An objective of the dispenser 10 is that the dilatant or soft-solid material 38 be prevented from leaking past the platform 90 onto the user's hands or to a shelf or other substrate upon which the dispenser rests when not in use. This sealing engagement is preferably accomplished by at least one wiper 112 and/or at least one bead 114 projecting generally radially from the platform peripheral edge 96. The wiper 112 and the bead 114 extend around the outer circumference of the platform peripheral edge 96 and wipingly contact the inner surface 44, and thus slidingly and sealingly engage the inner surface. In the preferred embodiment, the wiper 112 is formed integral to and projecting from the platform peripheral edge 96, at an approximate 30° angle thereto.

In the embodiment depicted, the platform 90 has a circumference "c" slightly smaller than a circumference "d" of the inner surface 44, so that the platform peripheral edge 96 is slightly spaced from the inner surface 44, and defines a gap 116 therebetween. The size of the gap 116 will vary with the application, but will generally fall within the range of about 0.0 inches to 0.010 inches, and in the preferred embodiment, the gap 116 is about 0.007 inches. It is also contemplated that, depending on the viscosity of the material 38, and/or the size of the gap 116, the wiper 112 and the bead 114 may both be omitted without requiring supplemental support for the platform 90.

Referring now to FIG. 3, the bead 114 is preferably integral to, and projects generally radially from the platform peripheral edge 96, so that the bead 114 substantially fills the gap 116. A generally coplanar relationship is formed between the bead 114 and the platform 90. As shown, the bead 114 is provided with a plurality of support gussets 118 which project laterally from the platform 90. The present invention is not limited to the number, configuration, angular orientation, method of joining and/or spacing of the wiper 112 and the bead 114. In the embodiment depicted in FIG. 2, preferably one of the wiper 112 and the bead 114 are used. Moreover, the wiper 112 and the bead 114 are depicted as being integral to and extending from the platform 90. However, other methods for securing the wiper and bead, 112 and 114 respectively, to the platform 90 are contemplated, including chemical adhesives and ultrasonic welding.

It has been found that the highly viscous soft-solid material 38 releasably adheres both to the platform 90 and to the inner surface 44 of the housing 14. As such, the soft-solid material 38, in conjunction with the wiper 112 and the bead 114, act to maintain the desired position of the platform 90 within the housing 14. In the preferred embodiment, the soft-solid material 38 is comprised by weight of at least 45% particulate matter, approximately 10% non-volatile emollient, and approximately 6% gelling agent. More specifically, the dilatant material 38 contains by weight about 10% dimethicone, about 6 to 8% behenoxy dimethicone (Abil Wax 2440), about 6% castor wax, about 1.5% silica, about 26.5% antiperspirant active, about 5 to 10% cosmetic powder and a volatile silicone medium.

The material is made by first preparing two "Premix" compositions, Premix A and Premix B are prepared. Premix A is made by mixing the Abil Wax 2440 (liquid emollient), castor wax, and a portion of the volatile silicone carrier and heating this mixture to a point above the melting point of the castor wax. Next, the mixture is cooled under shear to a point well below the setting point of the mixture to form a soft, pliable wax which may be stored for future use. Premix B is prepared by mixing the remainder of the volatile silicone carrier, the silica, and fragrance (if used) under high shear to form a stiff, silica slurry, which may be stored for later use.

To prepare the material 38, a cold process is used wherein Premix A, Premix B, and the dimethicone are mixed under shear until homogenous. The antiperspirant active and cosmetic powder are then added and mixed to yield the dilatant antiperspirant soft-solid.

Referring now to FIGS. 2–4, the manner in which the subject dispenser 10 operates is shown in greater detail. The user 110 applies a force to the platform 90 by manually pushing the platform 90 towards the top 60 of the housing 14 (in the direction of arrow P). The platform 90 compresses the soft-solid material 38 against the top 60, creating an stress in the material. This stress causes the soft-solid material 38 to move through the dispensing openings 64, thus dispensing a desired quantity of the material for application.

After the desired quantity of the soft-solid material 38 has been dispensed, the user 10 removes the force by ceasing to push against the platform 90. Any advance of the platform 90 toward the dispensing openings 64 is terminated, as is the compression force exerted upon the material 38. However, the residual stress retained by the material causes the platform 90 to move in a reverse direction, axially away from the top 60. The material 38 continues to push against the platform 90, causing it to move axially away from the top 60, until substantially all the residual stress in the material is released.

Referring now to FIG. 4, the replaceable cap 12 is depicted in a closed relationship upon the housing 14. The replaceable cap 14 engages the upper edge 48 of the housing 14 and covers the top 60 with a tight friction fit, and thus traps the volume of air 36 when closing or engaging the housing. After the desired amount of the material 38 is dispensed, the user 110 places the replaceable cap 12 on the upper edge 48 of the housing 14. In addition to the ability of the platform 90 to recede away from the top 60 to relieve residual stress, the volume of air 36 trapped in the replaceable cap 12 has been found to further push the material 38, and the platform 90, away from the dispensing openings 64 and back towards the lower opening 54. The use of the cap 112 in this manner allows the gap 116 to be smaller, thus reducing the potential for leakage of material past the wiper 112 and bead 114. As such, unwanted weeping and creeping is prevented, and in addition, the stress is relieved, so that the material will not separate into liquid and solid components and ultimately seize, prohibiting the free flow of the material.

While a particular embodiment of the present dispenser has been shown and described, it will be appreciated by those skilled in the art that changes and modifications may be made thereto without departing from the invention its broad aspects and as set forth in the following claims.

What is claimed is:

1. A dispensing container with a highly viscous antiperspirant formulated material stored therein, the container comprising:

a generally tubular housing having an upper end and an inner surface;

a top secured to said upper end of said housing and having multiple restricted dispensing openings;

a platform having a peripheral edge sealingly engaging said inner surface of said housing and configured with a wiper and a bead projecting from said peripheral edge for reciprocal axial movement within said housing, said peripheral edge slidingly guided by said inner surface of said housing for supporting said platform at a desired position within said housing, said platform configured for being slidably advanced toward said dispensing openings by exertion of force by a user, said force compressing the material against the top, and upon release of said force, said platform configured to slidably move in a reverse direction to relieve residual stress in the material;

a replaceable cap engaging said upper end of said housing, said cap having a tight friction fit with said housing to trap a volume of air when engaging said housing, said trapped volume of air being sufficient to retract said platform axially away from said top to further relieve residual stress in the material; and a dilatant soft-solid which is the antiperspirant formulated material contained in said housing upon said platform.

2. The container of claim 1 wherein said peripheral edge is spaced from said inner surface to define a gap therebetween, and said bead projecting radially from said peripheral edge to substantially fill said gap.

3. The container of claim 1 wherein said housing and said top are separate pieces, configured to be fastened together.

4. The container of claim 3 wherein said peripheral edge is spaced from said inner surface to define a gap therebetween, and said peripheral edge includes a bead projecting radially from said peripheral edge to substantially fill said gap.

5. The container of claim 1 wherein said soft-solid material includes a particle constituent, an antiperspirant active, a non-volatile emollient, a gelling agent and a thickener.

6. The container of claim 5 wherein said soft-solid material includes by weight at least 45% particle matter, approximately 10% non-volatile emollient, and approximately 6% gelling agent.

7. The container of claim 1 wherein said soft-solid material contains by weight about 10% dimethicone, about 6 to 8% behenoxy dimethicone, about 6% castor wax, about 1.5% silica, about 26.5% antiperspirant active, about 5 to 10% cosmetic powder and a volatile silicone medium.

* * * * *